US010807152B2

(12) United States Patent
Ownby et al.

(10) Patent No.: US 10,807,152 B2
(45) Date of Patent: Oct. 20, 2020

(54) MOLD ASSEMBLIES THAT ACTIVELY HEAT INFILTRATED DOWNHOLE TOOLS

(71) Applicant: Halliburton Energy Services, Inc., Houston, TX (US)

(72) Inventors: Clayton A. Ownby, Houston, TX (US); Grant O. Cook, III, Spring, TX (US); Jeffrey G. Thomas, Magnolia, TX (US); Ronald Eugene Joy, Katy, TX (US); Garrett T. Olsen, The Woodlands, TX (US); Daniel Brendan Voglewede, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/425,493

(22) Filed: May 29, 2019

(65) Prior Publication Data

US 2019/0283118 A1 Sep. 19, 2019

Related U.S. Application Data

(62) Division of application No. 14/781,047, filed as application No. PCT/US2014/068107 on Dec. 2, 2014, now Pat. No. 10,350,672.

(51) Int. Cl.
*B22C 9/06* (2006.01)
*B22C 9/22* (2006.01)
(Continued)

(52) U.S. Cl.
CPC ..... *B22C 9/065* (2013.01); *B22C 9/088* (2013.01); *B22C 9/22* (2013.01); *B22D 19/06* (2013.01);
(Continued)

(58) Field of Classification Search
CPC ..... B22C 9/065; B22C 9/22; B22D 19/06; B22D 23/06; B22D 25/02; B22D 27/045
See application file for complete search history.

(56) References Cited

U.S. PATENT DOCUMENTS 5,275,227 A 1/1994 Staub
5,373,907 A 12/1994 Weaver
(Continued)

FOREIGN PATENT DOCUMENTS

JP 10216900 8/1998
JP 11028596 2/1999

OTHER PUBLICATIONS

Office Action for U.S. Appl. No. 14/781,047 dated Oct. 12, 2017.
(Continued)

*Primary Examiner* — Kevin E Yoon
(74) *Attorney, Agent, or Firm* — Thomas Rooney; C. Tumey Law Group PLLC

(57) ABSTRACT

A mold assembly and method for fabricating an infiltrated drill bit may comprise a mold forming a bottom of the mold assembly, a funnel operatively coupled to the mold, an infiltration chamber defined at least partially by the mold and the funnel to receive and contain matrix reinforcement materials and a binder material used to form the infiltrated drill bit, a displacement core arranged within the infiltration chamber and having one or more legs that extend therefrom, a metal blank arranged about the displacement core within the infiltration chamber, and one or more thermal elements. A method may comprise providing a mold assembly having component parts that include a mold that forms a bottom of the mold assembly and a funnel operatively coupled to the mold, imparting thermal energy to the infiltration chamber with one or more thermal element, and heating contents contained within the infiltration chamber.

20 Claims, 7 Drawing Sheets

(51) Int. Cl.

| | |
|---|---|
| ***B22D 19/06*** | (2006.01) |
| ***B22D 25/02*** | (2006.01) |
| ***C22C 29/06*** | (2006.01) |
| ***B22F 3/02*** | (2006.01) |
| ***B22F 3/12*** | (2006.01) |
| ***B22F 7/06*** | (2006.01) |
| ***B22C 9/08*** | (2006.01) |
| ***B22D 23/06*** | (2006.01) |
| ***B22D 27/04*** | (2006.01) |
| ***E21B 7/00*** | (2006.01) |
| *B22F 5/00* | (2006.01) |
| *E21B 10/42* | (2006.01) |
| *E21B 10/55* | (2006.01) |

(52) U.S. Cl.

CPC ..... *B22D 23/06* (2013.01); *B22D 25/02* (2013.01); *B22D 27/045* (2013.01); *B22F 3/02* (2013.01); *B22F 3/12* (2013.01); *B22F 7/06* (2013.01); *C22C 29/06* (2013.01); *E21B 7/00* (2013.01); *B22F 2005/001* (2013.01); *B22F 2007/066* (2013.01); *B22F 2203/11* (2013.01); *B22F 2999/00* (2013.01); *E21B 10/42* (2013.01); *E21B 10/55* (2013.01)

(56) References Cited

U.S. PATENT DOCUMENTS

| | | | | |
|---|---|---|---|---|
| 5,666,864 | A | 9/1997 | Tibbitts | |
| 6,210,478 | B1 | 4/2001 | Bewlay et al. | |
| 6,220,117 | B1 | 4/2001 | Butcher | |
| 6,308,767 | B1 | 10/2001 | Hugo et al. | |
| 6,932,145 | B2 | 8/2005 | Frasier et al. | |
| 7,343,960 | B1 | 3/2008 | Frasier et al. | |
| 7,377,305 | B2 | 5/2008 | Frasier et al. | |
| 7,418,993 | B2 | 9/2008 | Frasier et al. | |
| 7,779,890 | B2 | 8/2010 | Frasier et al. | |
| 7,824,494 | B2 | 11/2010 | Frasier et al. | |
| 8,047,260 | B2 | 11/2011 | Uno et al. | |
| 8,082,976 | B2 | 12/2011 | Frasier et al. | |
| 8,087,446 | B2 | 1/2012 | Frasier et al. | |
| 8,181,692 | B2 | 5/2012 | Frasier et al. | |
| 8,272,295 | B2 | 9/2012 | Smith et al. | |
| 8,550,144 | B2 | 10/2013 | Frasier et al. | |
| 2008/0028891 | A1 | 2/2008 | Calnan et al. | |
| 2009/0301682 | A1* | 12/2009 | Proske ..... | B22D 27/04 164/80 |
| 2010/0101747 | A1 | 4/2010 | Tomczak et al. | |
| 2010/0212860 | A1 | 8/2010 | Rule | |
| 2011/0121475 | A1 | 5/2011 | Reese et al. | |
| 2011/0164650 | A1 | 7/2011 | Chen et al. | |
| 2011/0167734 | A1 | 7/2011 | Jiang et al. | |
| 2012/0298323 | A1 | 11/2012 | Thomas | |
| 2013/0313403 | A1 | 11/2013 | Atkins et al. | |
| 2013/0333950 | A1 | 12/2013 | Atkins et al. | |
| 2015/0165665 | A1 | 6/2015 | Guichard et al. | |

OTHER PUBLICATIONS

Office Action for U.S. Appl. No. 14/781,047 dated Jun. 11, 2018.
Notice of Allowance for U.S. Appl. No. 14/781,047 dated Mar. 11, 2019.
Final Office Action for U.S. Appl. No. 14/781,047 dated Oct. 12, 2018.
Final Office Action for U.S. Appl. No. 14/781,047 dated Feb. 12, 2018.
Restriction Requirement for U.S. Appl. No. 14/781,047 dated Jul. 26, 2017.
International Search Report and Written Opinion for PCT/US2014/068107 dated Sep. 2, 2015.

* cited by examiner

MOLD ASSEMBLIES THAT ACTIVELY HEAT INFILTRATED DOWNHOLE TOOLS

BACKGROUND

A variety of downhole tools are used in the exploration and production of hydrocarbons. Examples of such downhole tools include cutting tools, such as drill bits, reamers, stabilizers, and coring bits; drilling tools, such as rotary steerable devices and mud motors; and other downhole tools, such as window mills, packers, tool joints, and other wear-prone tools. Rotary drill bits are often used to drill wellbores. One type of rotary drill bit is a fixed-cutter drill bit that has a bit body comprising matrix and reinforcement materials, i.e., a "matrix drill bit" as referred to herein. Matrix drill bits usually include cutting elements or inserts positioned at selected locations on the exterior of the matrix bit body. Fluid flow passageways are formed within the matrix bit body to allow communication of drilling fluids from associated surface drilling equipment through a drill string or drill pipe attached to the matrix bit body.

Matrix drill bits may be manufactured by placing powder material into a mold and infiltrating the powder material with a binder material, such as a metallic alloy. The various features of the resulting matrix drill bit, such as blades, cutter pockets, and/or fluid-flow passageways, may be provided by shaping the mold cavity and/or by positioning temporary displacement materials within interior portions of the mold cavity. A preformed bit blank (or mandrel) may be placed within the mold cavity to provide reinforcement for the matrix bit body and to allow attachment of the resulting matrix drill bit with a drill string. A quantity of matrix reinforcement material (typically in powder form) may then be placed within the mold cavity with a quantity of the binder material.

The mold is then placed within a furnace and the temperature of the mold is increased to a desired temperature to allow the binder (e.g., metallic alloy) to liquefy and infiltrate the matrix reinforcement material. The furnace may maintain this desired temperature to the point that the infiltration process is deemed complete, such as when a specific location in the bit reaches a certain temperature. Once the designated process time or temperature has been reached, the mold containing the infiltrated matrix bit is removed from the furnace. As the mold is removed from the furnace, the mold begins to rapidly lose heat to its surrounding environment via heat transfer, such as radiation and/or convection in all directions.

This heat loss continues to a large extent until the mold is moved and placed on a cooling plate and an insulation enclosure or "hot hat" is lowered around the mold. The insulation enclosure drastically reduces the rate of heat loss from the top and sides of the mold while heat is drawn from the bottom of the mold through the cooling plate. This controlled cooling of the mold and the infiltrated matrix bit contained therein can facilitate axial solidification dominating radial solidification, which is loosely termed directional solidification.

As the molten material of the infiltrated matrix bit cools, there is a tendency for shrinkage that could result in voids forming within the bit body unless the molten material is able to continuously backfill such voids. In some cases, for instance, one or more intermediate regions within the bit body may solidify prior to adjacent regions and thereby stop the flow of molten material to locations where shrinkage porosity is developing. In other cases, shrinkage porosity may result in poor metallurgical bonding at the interface between the bit blank and the molten materials, which can result in the formation of cracks within the bit body that can be difficult or impossible to inspect. When such bonding defects are present and/or detected, the drill bit is often scrapped during or following manufacturing assuming they cannot be remedied. Every effort is made to detect these defects and reject any defective drill bit components during manufacturing to help ensure that the drill bits used in a job at a well site will not prematurely fail and to minimize any risk of possible damage to the well.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to downhole tool manufacturing and, more particularly, to mold assembly configurations that actively heat infiltrated downhole tools during fabrication.

The embodiments described herein improve directional solidification of infiltrated downhole tools by introducing alternative designs to standard mold assembly components used during the infiltration process to achieve a desired thermal profile of the infiltrated downhole tool. According to the present disclosure, the exemplary mold assemblies may include at least a mold that forms a bottom of the mold assembly and a funnel that is operatively coupled to the mold. An infiltration chamber may be defined at least partially by the mold and the funnel to receive and contain matrix reinforcement materials and a binder material used to form a given infiltrated downhole tool. One or more thermal elements may be positioned within at least one of the mold, the funnel, the metal blank (mandrel), and, a displacement member to impart thermal energy to the infiltration chamber during the infiltration process or during cooling, or both. The thermal elements may be selectively controlled, either uniformly or independently, to generate a desired thermal gradient along a height of the mold assembly, and thereby improve directional solidification of the given infiltrated downhole tool being fabricated using the mold assembly. Among other things, this may improve quality and reduce the rejection rate of drill bit components due to defects during manufacturing.

Figure 1:
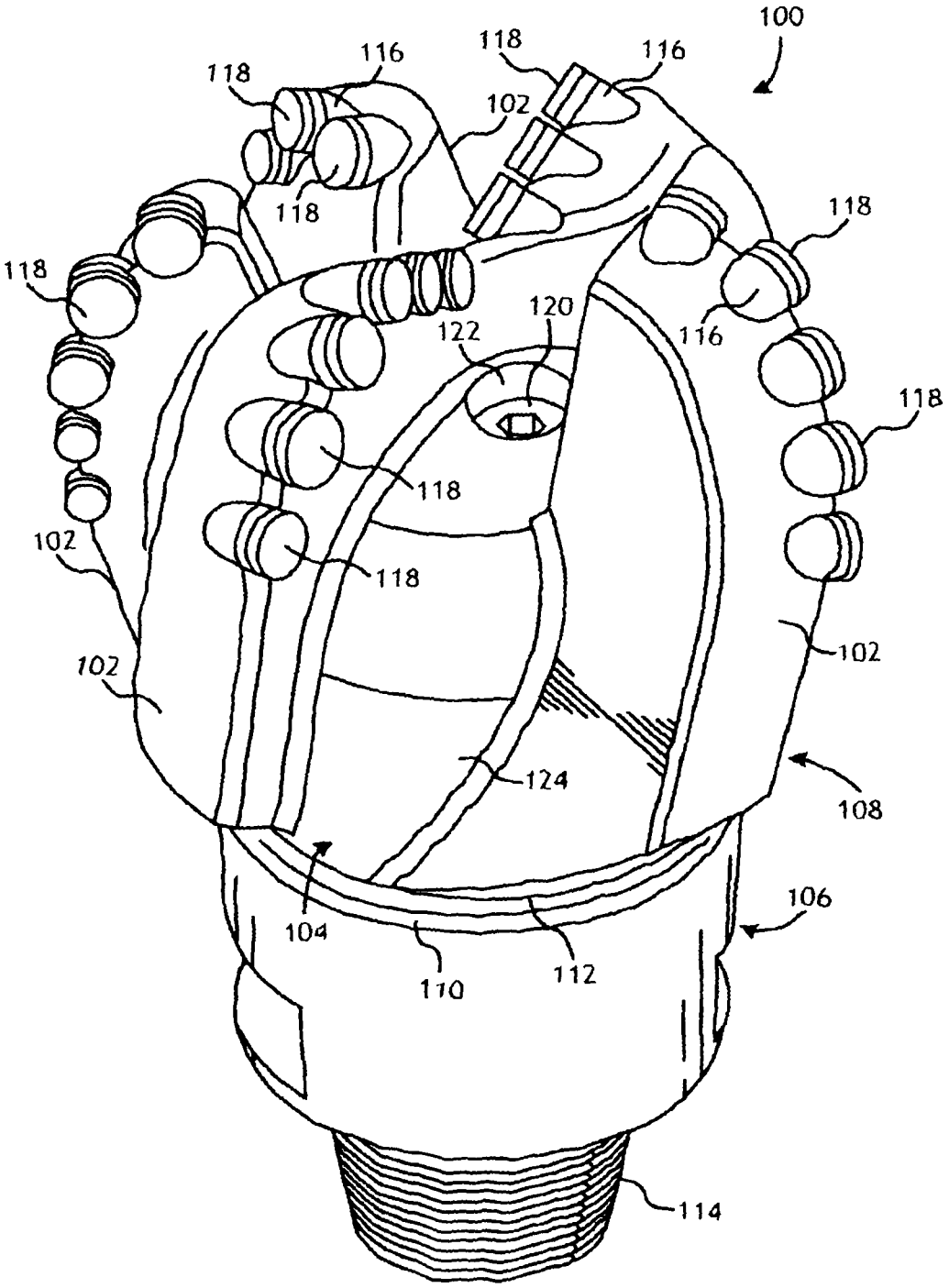
FIG. 1 is a perspective view of an exemplary fixed-cutter drill bit that may be fabricated in accordance with the principles of the present disclosure.

FIG. 1 illustrates a perspective view of an example fixed-cutter drill bit 100 that may be fabricated in accordance with the principles of the present disclosure. It should be noted that, while FIG. 1 depicts a fixed-cutter drill bit 100, the principles of the present disclosure are equally applicable to any type of downhole tool that may be formed or otherwise manufactured through an infiltration process. For example, suitable infiltrated downhole tools that may be manufactured in accordance with the present disclosure include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters, cutting elements), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, washover tools, rotors, stators and/or housings for downhole drilling motors, blades and housings for downhole turbines, and other downhole tools having complex configurations and/or asymmetric geometries associated with forming a wellbore.

As illustrated in FIG. 1, the fixed-cutter drill bit 100 (hereafter "the drill bit 100") may include or otherwise define a plurality of cutter blades 102 arranged along the circumference of a bit head 104. The bit head 104 is connected to a shank 106 to form a bit body 108. The shank 106 may be connected to the bit head 104 by welding, brazing, or other fusion methods, such as submerged arc or metal inert gas arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple recesses or pockets 116 are formed. Cutting elements 118 may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each adjacent pair of cutter blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

Figure 2:
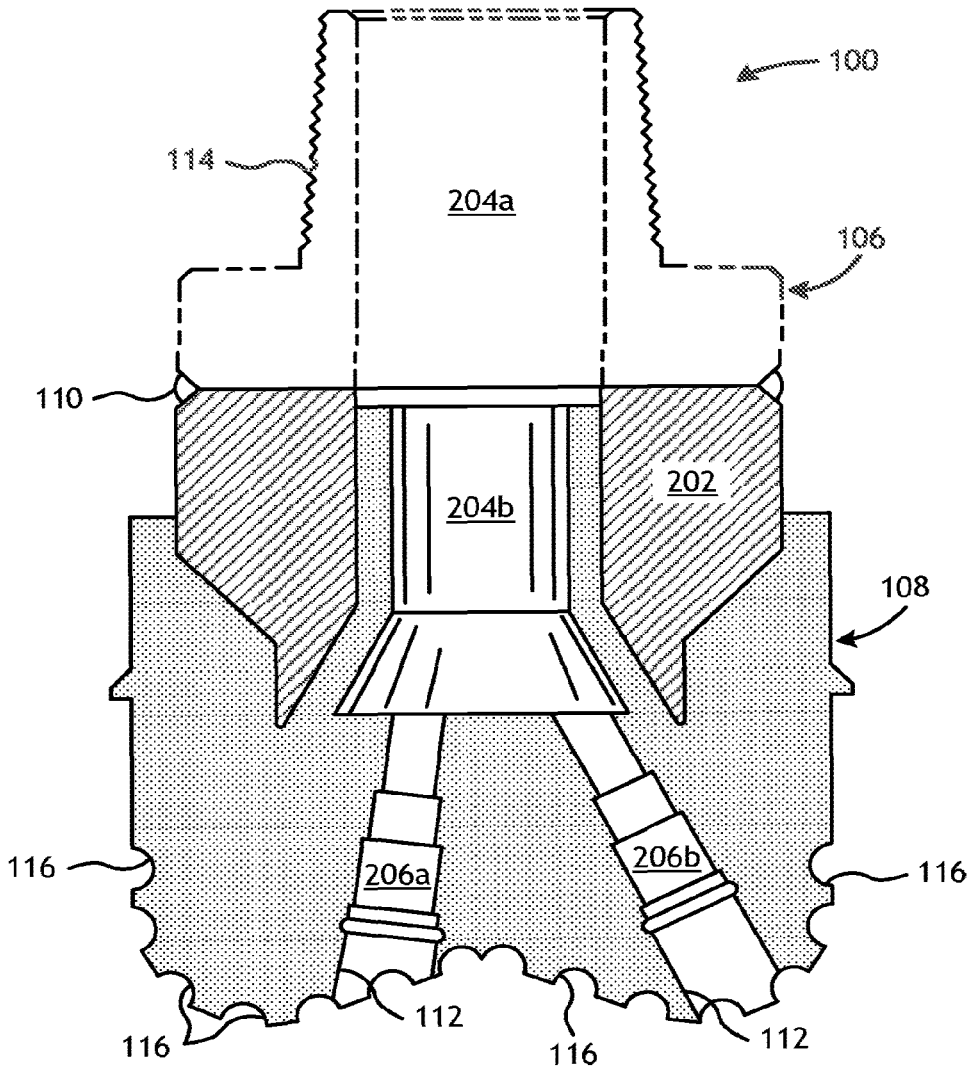
FIG. 2 is a cross-sectional view of the drill bit of FIG. 1.

FIG. 2 is a cross-sectional side view of the drill bit 100 of FIG. 1. Similar numerals from FIG. 1 that are used in FIG. 2 refer to similar components that are not described again. As illustrated, the shank 106 may be securely attached to a metal blank (or mandrel) 202 at the weld 110 and the metal blank 202 extends into the bit body 108. The shank 106 and the metal blank 202 are generally cylindrical structures that define corresponding fluid cavities 204*a* and 204*b*, respectively, in fluid communication with each other. The fluid cavity 204*b* of the metal blank 202 may further extend longitudinally into the bit body 108. At least one flow passageway (shown as two flow passageways 206*a* and 206*b*) may extend from the fluid cavity 204*b* to exterior portions of the bit body 108. The nozzle openings 122 may be defined at the ends of the flow passageways 206*a* and 206*b* at the exterior portions of the bit body 108. The pockets 116 are formed in the bit body 108 and are shaped or otherwise configured to receive the cutting elements 118 (FIG. 1).

Figure 3:
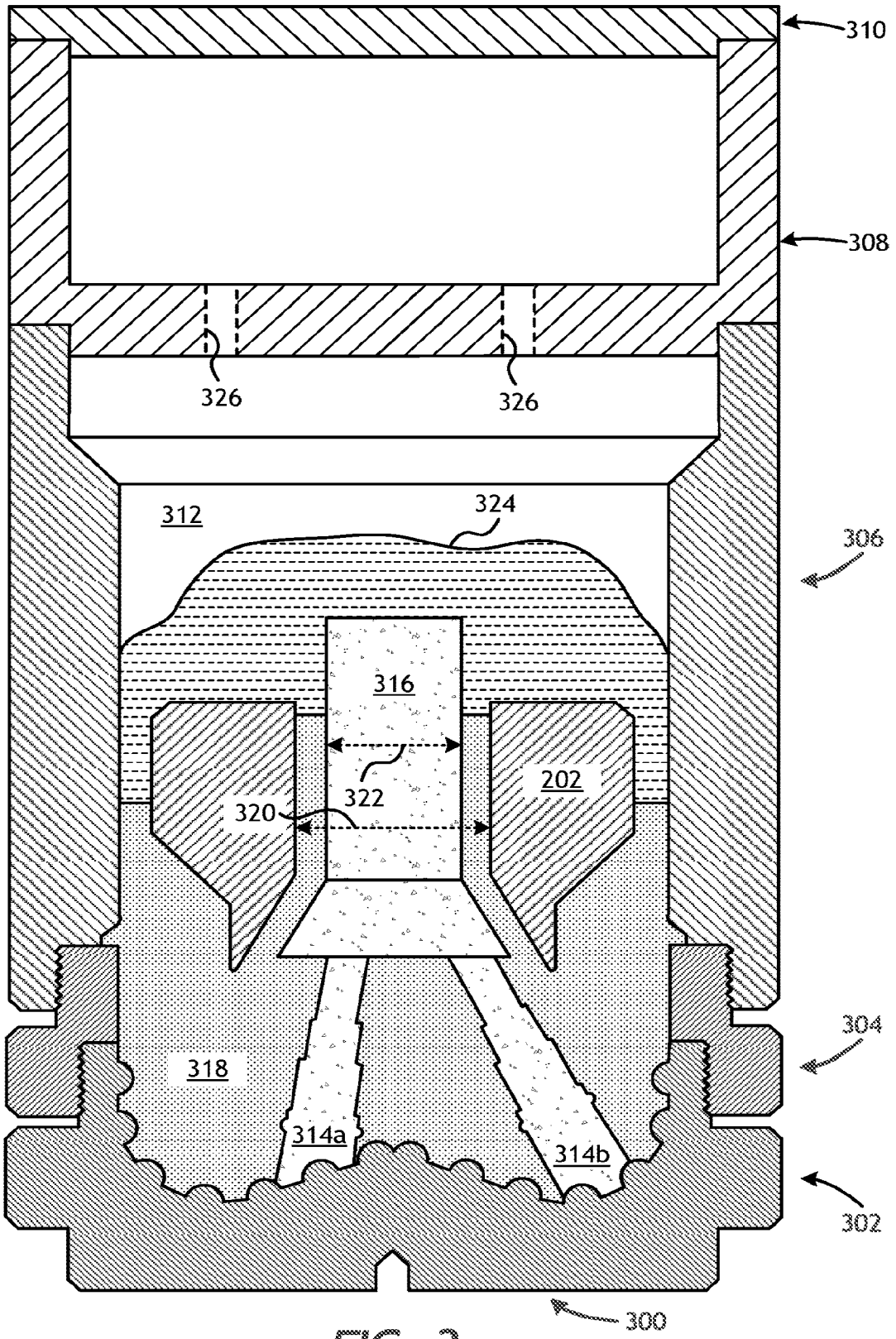
FIG. 3 is a cross-sectional side view of an exemplary mold assembly for use in forming the drill bit of FIG. 1.

FIG. 3 is a cross-sectional side view of a mold assembly 300 that may be used to form the drill bit 100 of FIGS. 1 and 2. While the mold assembly 300 is shown and discussed as being used to help fabricate the drill bit 100, those skilled in the art will readily appreciate that mold assembly 300 and its several variations described herein may be used to help fabricate any of the infiltrated downhole tools mentioned above, without departing from the scope of the disclosure. As illustrated, the mold assembly 300 may include several components such as a mold 302, a gauge ring 304, and a funnel 306. In some embodiments, the funnel 306 may be operatively coupled to the mold 302 via the gauge ring 304, such as by corresponding threaded engagements, as illustrated. In other embodiments, the gauge ring 304 may be omitted from the mold assembly 300 and the funnel 306 may be instead be operatively coupled directly to the mold 302, such as via a corresponding threaded engagement, without departing from the scope of the disclosure.

In some embodiments, as illustrated, the mold assembly 300 may further include a binder bowl 308 and a cap 310 placed above the funnel 306. The mold 302, the gauge ring 304, the funnel 306, the binder bowl 308, and the cap 310 may each be made of or otherwise comprise graphite or alumina ($Al_2O_3$), for example, or other suitable materials. An infiltration chamber 312 may be defined or otherwise provided within the mold assembly 300. Various techniques may be used to manufacture the mold assembly 300 and its components including, but not limited to, machining graphite blanks to produce the various components and thereby define the infiltration chamber 312 to exhibit a negative or reverse profile of desired exterior features of the drill bit 100 (FIGS. 1 and 2).

Materials, such as consolidated sand or graphite, may be positioned within the mold assembly 300 at desired locations to form various features of the drill bit 100 (FIGS. 1 and 2). For example, consolidated sand legs 314*a* and 314*b* may be positioned to correspond with desired locations and configurations of the flow passageways 206*a,b* (FIG. 2) and their respective nozzle openings 122 (FIGS. 1 and 2). Moreover, a cylindrically-shaped consolidated displacement core 316 may be placed on the legs 314*a,b*. The number of legs 314*a,b* extending from the displacement core 316 will depend upon the desired number of flow passageways and corresponding nozzle openings 122 in the drill bit 100.

After the desired materials, including the displacement core 316 and the legs 314*a,b*, have been installed within the mold assembly 300, matrix reinforcement materials 318 may then be placed within or otherwise introduced into the mold assembly 300. For some applications, two or more different types of matrix reinforcement materials 318 may be deposited in the mold assembly 300. Suitable matrix reinforcement materials 318 include, but are not limited to, tungsten carbide, monotungsten carbide (WC), ditungsten carbide ($W_2C$), macrocrystalline tungsten carbide, other metal carbides, metal borides, metal oxides, metal nitrides, natural and synthetic diamond, and polycrystalline diamond (PCD). Examples of other metal carbides may include, but are not limited to, titanium carbide and tantalum carbide, and various mixtures of such materials may also be used.

The metal blank 202 may be supported at least partially by the matrix reinforcement materials 318 within the infiltration chamber 312. More particularly, after a sufficient volume of the matrix reinforcement materials 318 has been added to the mold assembly 300, the metal blank 202 may then be placed within mold assembly 300 and concentrically-arranged about the displacement core 316. The metal blank 202 may include an inside diameter 320 that is greater than an outside diameter 322 of the displacement core 316, and various fixtures (not expressly shown) may be used to position the metal blank 202 within the mold assembly 300 at a desired location. The matrix reinforcement materials 318 may then be filled to a desired level within the infiltration chamber 312.

Binder material 324 may then be placed on top of the matrix reinforcement materials 318, the metal blank 202, and the core 316. Various types of binder materials 324 may be used and include, but are not limited to, metallic alloys of copper (Cu), nickel (Ni), manganese (Mn), lead (Pb), tin (Sn), cobalt (Co), Phosphorous (P), and silver (Ag). Various mixtures of such metallic alloys may also be used as the binder material 324. In some embodiments, the binder material 324 may be covered with a flux layer (not expressly shown). The amount of binder material 324 and optional flux material added to the infiltration chamber 312 should be at least enough to infiltrate the matrix reinforcement materials 318 during the infiltration process. In some instances, some or all of the binder material 324 may be placed in the binder bowl 308, which may be used to distribute the binder material 324 into the infiltration chamber 312 via various conduits 326 that extend therethrough. The cap 310 (if used) may then be placed over the mold assembly 300, thereby readying the mold assembly 300 for heating.

Figure 4A:
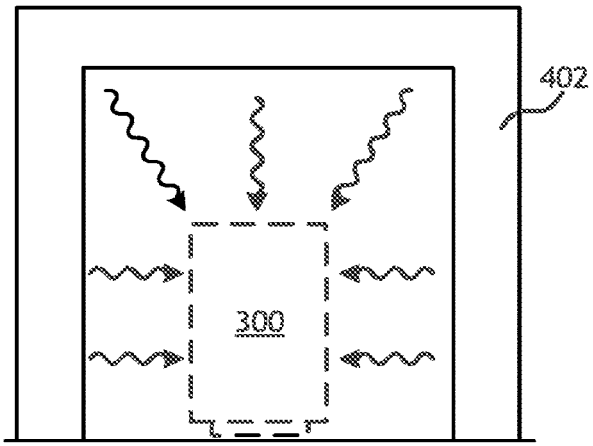
FIGS. 4A-4C are progressive schematic diagrams of an exemplary method of fabricating a drill bit.
Figure 4B:
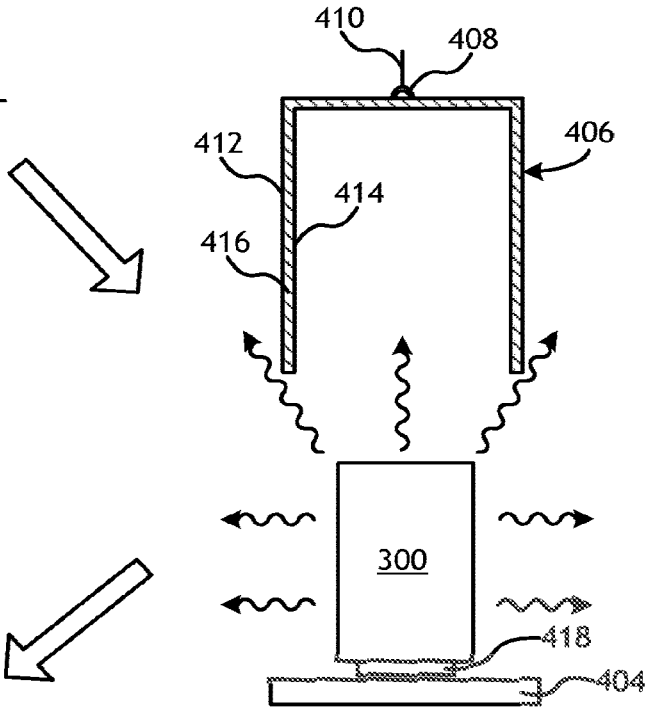
Figure 4C:
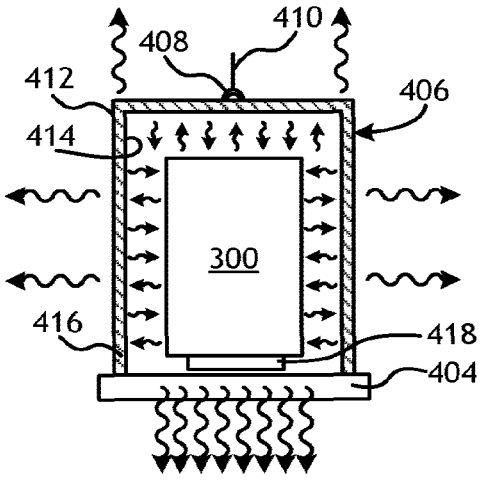

Referring now to FIGS. 4A-4C, with continued reference to FIG. 3, illustrated are schematic diagrams that sequentially illustrate an example method of heating and cooling the mold assembly 300 of FIG. 3, in accordance with the principles of the present disclosure. In FIG. 4A, the mold assembly 300 is depicted as being positioned within a furnace 402. The temperature of the mold assembly 300 and its contents are elevated within the furnace 402 until the binder material 324 liquefies and is able to infiltrate the matrix reinforcement materials 318. Once a specific location in the mold assembly 300 reaches a certain temperature in the furnace 402, or the mold assembly 300 is otherwise maintained at a particular temperature for a predetermined amount of time, the mold assembly 300 is then removed from the furnace 402 and immediately begins to lose heat by radiating thermal energy to its surroundings while heat is also convected away by cooler air outside the furnace 402. In some cases, as depicted in FIG. 4B, the mold assembly 300 may be transported to and set down upon a thermal heat sink 404.

The radiative and convective heat losses from the mold assembly 300 to the environment continue until an insulation enclosure 406 is lowered around the mold assembly 300. The insulation enclosure 406 may be a rigid shell or structure used to insulate the mold assembly 300 and thereby slow the cooling process. In some cases, the insulation enclosure 406 may include a hook 408 attached to a top surface thereof. The hook 408 may provide an attachment location, such as for a lifting member, whereby the insulation enclosure 406 may be grasped and/or otherwise attached to for transport. For instance, a chain or wire 410 may be coupled to the hook 408 to lift and move the insulation enclosure 406, as illustrated. In other cases, a mandrel or other type of manipulator (not shown) may grasp onto the hook 408 to move the insulation enclosure 406 to a desired location.

The insulation enclosure 406 may include an outer frame 412, an inner frame 414, and insulation material 416 arranged between the outer and inner frames 412, 414. In some embodiments, both the outer frame 412 and the inner frame 414 may be made of rolled steel and shaped (i.e., bent, welded, etc.) into the general shape, design, and/or configuration of the insulation enclosure 406. In other embodiments, the inner frame 414 may be a metal wire mesh that holds the insulation material 416 between the outer frame 412 and the inner frame 414. The insulation material 416 may be selected from a variety of insulative materials, such as those discussed below. In at least one embodiment, the insulation material 416 may be a ceramic fiber blanket, such as INSWOOL® or the like.

As depicted in FIG. 4C, the insulation enclosure 406 may enclose the mold assembly 300 such that thermal energy radiating from the mold assembly 300 is dramatically reduced from the top and sides of the mold assembly 300 and is instead directed substantially downward and otherwise toward/into the thermal heat sink 404 or back towards the mold assembly 300. In the illustrated embodiment, the thermal heat sink 404 is a cooling plate designed to circulate a fluid (e.g., water) at a reduced temperature relative to the mold assembly 300 (i.e., at or near ambient) to draw thermal energy from the mold assembly 300 and into the circulating fluid, and thereby reduce the temperature of the mold assembly 300. In other embodiments, however, the thermal heat sink 404 may be any type of cooling device or heat exchanger configured to encourage heat transfer from the bottom 418 of the mold assembly 300 to the thermal heat sink 404. In yet other embodiments, the thermal heat sink 404 may be any stable or rigid surface that may support the mold assembly 300, and preferably having a high thermal capacity, such as a concrete slab or flooring.

Once the insulation enclosure 406 is positioned over the mold assembly 300 and the thermal heat sink 404 is operational, the majority of the thermal energy is transferred away from the mold assembly 300 through the bottom 418 of the mold assembly 300 and into the thermal heat sink 404. This controlled cooling of the mold assembly 300 and its contents allows an operator (or automated control system) to regulate or control the thermal profile of the mold assembly 300 to a certain extent and may result in directional solidification of the molten contents within the mold assembly 300, where axial solidification of the molten contents dominates radial solidification. Within the mold assembly 300, the face of the drill bit (i.e., the end of the drill bit that includes the cutters) may be positioned at the bottom 418 of the mold assembly 300 and otherwise adjacent the thermal heat sink 404 while the shank 106 (FIG. 1) may be positioned adjacent the top of the mold assembly 300. As a result, the drill bit 100 (FIGS. 1 and 2) may be cooled axially upward, from the cutters 118 (FIG. 1) toward the shank 106 (FIG. 1).

Such directional solidification (from the bottom up) may prove advantageous in reducing the occurrence of voids due to shrinkage porosity, cracks at the interface between the metal blank 202 and the molten materials within the infiltration chamber 312, and nozzle cracks. However, the insulating capability of the insulation enclosure 406 may require augmentation to produce a sufficient amount of directional cooling. According to embodiments of the present disclosure, as an alternative or in addition to using the insulation enclosure 406, mold assemblies for an infiltrated downhole tool may be modified to help influence the overall thermal profile of the infiltrated downhole tool (e.g., the drill bit 100 of FIGS. 1 and 2) and facilitate a sufficient amount of directional cooling. More particularly, embodiments of the present disclosure provide hybrid mold assembly designs that allow an operator (or automated control system) to selectively and actively heat various portions of a given mold assembly and thereby improve directional solidification of an infiltrated downhole tool. As described in more detail below, the hybrid configurations may be applied to one or all of the component parts of the given mold assembly.

Figure 5A:
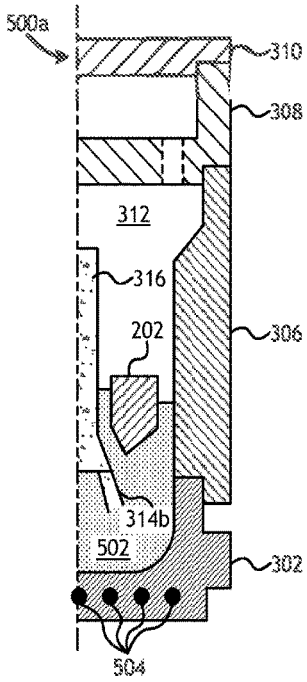
FIGS. 5A-5C are partial cross-sectional side views of various exemplary mold assemblies.
Figure 5B:
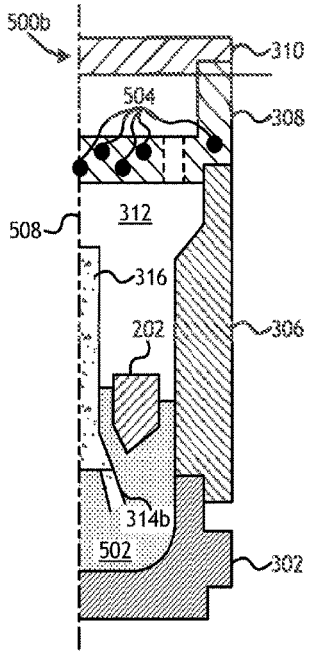
Figure 5C:
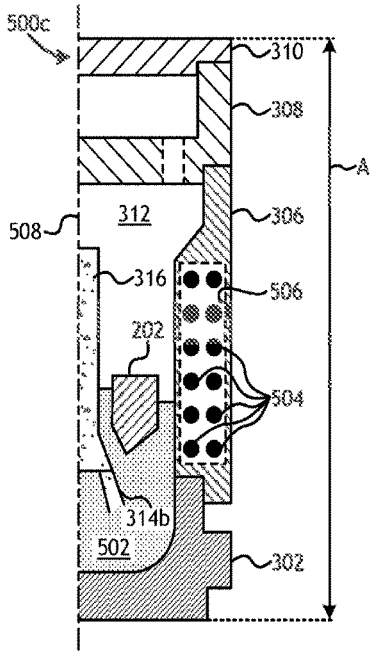

Referring now to FIGS. 5A-5C, illustrated are partial cross-sectional side views of various exemplary mold assemblies, according to one or more embodiments. More particularly, FIG. 5A depicts a first mold assembly 500*a*, FIG. 5B depicts a second mold assembly 500*b*, and FIG. 5C depicts a third mold assembly 500*c*. The mold assemblies 500*a-c* may be similar in some respects to the mold assembly 300 of FIG. 3 and therefore may be best understood with reference thereto, where like numerals represent like elements or components not described again. Each mold assembly 500*a-c* may include some or all of the component parts of the mold assembly 300 of FIG. 3. For instance, as illustrated, the mold assemblies 500*a-c* may each include some or all of the mold 302, the funnel 306, the binder bowl 308, and the cap 310. In some embodiments, while not shown in FIGS. 5A-5C, the gauge ring 304 (FIG. 3) may also be included in any of the mold assemblies 500*a-c*. Each mold assembly 500*a-c* may further include the metal blank 202, the displacement core 316, and one or more consolidated sand legs 314*b* (one shown), as generally described above. The foregoing components of the mold assemblies 500*a-c* are collectively referred to herein as the "component parts" of the mold assemblies 500*a-c* and any other mold assemblies described herein.

According to the present disclosure, the contents 502 within the infiltration chamber 312 of the mold assemblies 500*a-c* may be selectively and/or actively heated using one or more thermal elements 504 positioned within any of the component parts of the mold assemblies 500*a-c*. As used herein, the term "positioned within" can refer to physically embedding the thermal elements 504 within any of the component parts of the mold assemblies 500*a-c*, but may also refer to embodiments where the thermal elements 504 form an integral part of any of the component parts of the mold assemblies 500*a-c*. In yet other embodiments, as discussed below, the thermal elements 504 may be positioned within any of the component parts of the mold assemblies 500*a-c* by being arranged within a cavity 506 (FIG. 5C) defined within a given component part of a mold assembly 500*a-c*.

The thermal elements 504 may be configured to be in thermal communication with the contents 502 of the infiltration chamber 312. As used herein, the term "thermal communication," such as having the thermal elements 504 in "thermal communication" with the infiltration chamber 312 or the contents 502 thereof, may mean that activation of the thermal elements 504 may result in thermal energy being imparted and/or transferred to the infiltration chamber 312 or the contents 502 thereof from the thermal elements 504. In some embodiments, the contents 502 within the infiltration chamber 312 may include the individual or separated portions of the matrix reinforcement materials 318 (FIG. 3) and the binder material 324 (FIG. 3). In such embodiments, the thermal elements 504 may actively and/or selectively provide thermal energy to the matrix reinforcement materials 318 and the binder material 324 to help facilitate the infiltration process. In other embodiments, the contents 502 within the infiltration chamber 312 may be a molten mass of the matrix reinforcement materials 318 infiltrated by the binder material 324 following the infiltration process, and the thermal elements 504 may help directional solidification of the molten mass as it cools.

The thermal elements 504 may be any device or mechanism configured to impart thermal energy to the contents 502 within the infiltration chamber 312. For example, the thermal elements 504 may include, but are not limited to, a heating element, a heat exchanger, a radiant heater, an electric heater, an infrared heater, an induction heater, one or more induction coils, a heating band, one or more heated coils, a heated cartridge, resistive heating elements, a refractory and conductive metal coil, strip, or bar, a heated fluid (flowing or static), an exothermic chemical reaction, a microwave emitter, a tuned microwave receptive material, an exothermal subatomic reaction, or any combination thereof. Suitable configurations for a heating element may include, but are not be limited to, coils, plates, strips, finned strips, and the like, or any combination thereof. In embodiments where the thermal elements 504 comprise a heated fluid or an exothermic chemical reaction, the heated fluid or the exothermic chemical reaction may be circulated or disposed within associated conduits arranged within the given component parts of the mold assemblies 500*a-c*.

In FIG. 5A, the thermal elements 504 are depicted as being positioned within the mold 302 of the first mold assembly 500*a*. In some embodiments, the thermal elements 504 positioned in the mold 302 may comprise a single thermal element 504 array and thereby form a spiraling or coiled single thermal element 504 when viewed from a top view. In such embodiments, the thermal element 504 may be controlled via a single lead (not shown) connected to the thermal element 504. In other embodiments, however, the thermal elements 504 in the mold 302 may comprise a collection of thermal elements 504 that may be controlled together, or two or more sets of thermal elements 504 that may be controlled independent of each other. In yet other embodiments, the thermal elements 504 in the mold 302 may comprise individual and discrete thermal elements 504 that are each powered independent of the others. In such embodiments, each thermal element 504 would require connection to a corresponding discrete lead to control and power the corresponding thermal elements 504. As will be appreciated, such embodiments may prove advantageous in allowing an operator (or automated control system) to vary an intensity or heat output of each thermal element 504 independently, and thereby produce a desired heat gradient (also variable with time) within the mold 302.

In FIG. 5B, the thermal elements 504 are depicted as being positioned within the binder bowl 308. In some embodiments, as illustrated, the thermal elements 504 in the binder bowl 308 may form an alternating array, where each array forms a spiraling or coiled single thermal element 504 when viewed from a top view. Similar to the thermal elements 504 in FIG. 5A, the thermal elements 504 in FIG. 5B may comprise a single thermal element 504, where some portions of the thermal element 504 are axially offset from other portions with respect to a central axis 508. In other embodiments, the thermal elements 504 positioned in the binder bowl 308 may comprise two or more sets of thermal elements 504 that may be controlled independent of the other. In yet other embodiments, the thermal elements 504 positioned in the binder bowl 308 may comprise a plurality of individual and/or discrete thermal elements 504 that are each coupled to a corresponding discrete lead and powered/controlled independent of the others.

In FIG. 5C, the thermal elements 504 are depicted as being positioned within the funnel 306 and, more particularly, within a cavity 506 defined within the funnel 306. As will be appreciated, the thermal elements 504 may alternatively be embedded within the material of the funnel 306 or formed as an integral part thereof, without departing from the scope of the disclosure. The cavity 506 in the funnel 308 may be formed by known manufacturing techniques, such as milling or turning. In at least one embodiment, the funnel 306 may comprise a multi-component construction that allows easier fabrication of the cavity 506 to desired dimensions and/or geometries. As will be appreciated, the cavity 506 may alternatively (or in addition thereto) be defined or otherwise formed in any of the other component parts of the mold assembly 500*c*, without departing from the scope of the disclosure.

In the illustrated embodiment of FIG. 5C, the thermal elements 504 may be arranged within the cavity 506 in a double array, where some portions of the thermal elements 504 are radially offset from other portions with respect to the central axis 508. Similar to the thermal elements 504 in FIGS. 5A and 5B, the thermal elements 504 in FIG. 5C may comprise a single thermal element 504 looped within the cavity 506 and otherwise controlled by a single lead. In other embodiments, the thermal elements 504 positioned in the funnel 306 may comprise two or more sets of thermal elements 504, such as a first inner set (e.g., those closer to the central axis 508), and a second outer set (e.g., those further away from the central axis 508), where each set is controlled independent of the other. In yet other embodiments, each thermal element 504 positioned in the funnel 306 may be individually controlled and powered independent of the others.

As will be appreciated, being able to control the thermal output of the thermal elements 504 positioned within the funnel 306 may prove advantageous in being able to adjust and otherwise optimize the level of directional heat imparted by the thermal elements 504 into the infiltration chamber 312. As a result, a desired thermal gradient may be generated and optimized along an axial height A of the mold assembly 500*c* to help facilitate directional solidification of the molten contents 502 within the infiltration chamber 312. Moreover, it will be appreciated that the configuration (e.g., number, placement, spacing, size, etc.) of the thermal elements 504 in the funnel 306 (or any of the other component parts) may be optimized and/or selectively operated in order to further enhance the thermal gradient along the axial height A.

Figure 6A:
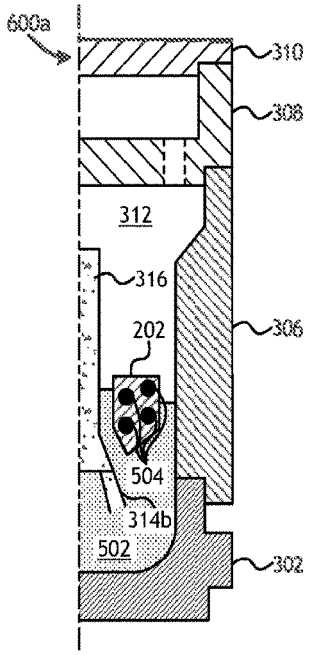
FIGS. 6A and 6B are partial cross-sectional side views of additional exemplary mold assemblies.
Figure 6B:
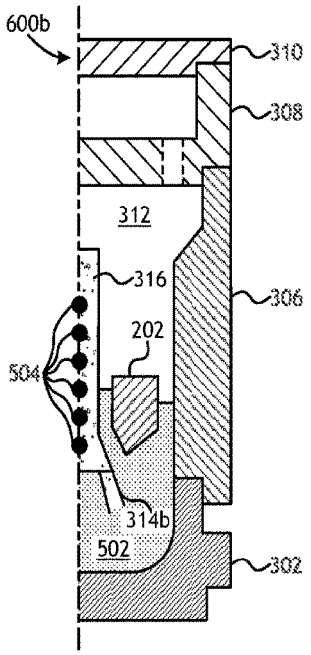

Referring now to FIGS. 6A and 6B, illustrated are partial cross-sectional side views of additional exemplary mold assemblies, according to one or more embodiments. More particularly, FIG. 6A depicts a first mold assembly 600*a* and FIG. 6B depicts a second mold assembly 600*b*. Similar to the mold assemblies 500*a-c* of FIGS. 5A-5C, the mold assemblies 600*a,b* may be similar in some respects to the mold assembly 300 of FIG. 3 and therefore may be best understood with reference thereto, where like numerals represent like elements not described again. As illustrated, the mold assemblies 600*a,b* may each include one or more of the mold 302, the funnel 306, the binder bowl 308, and the cap 310, but could alternatively also include the gauge ring 304 (FIG. 3), without departing from the scope of the disclosure. Each mold assembly 600*a,b* may further include the metal blank 202, the displacement core 316, and one or more consolidated sand legs 314*b* (one shown).

The mold assemblies 600*a,b* may also be similar in some respects to the mold assemblies 500*a-c* of FIGS. 5A-5C in that the contents 502 within the infiltration chamber 312 may be selectively and/or actively heated using the thermal elements 504 positioned within any of the component parts of the mold assemblies 600*a,b*. In FIG. 6A, for example, the thermal elements 504 may be positioned within the metal blank 202. Similar to prior embodiments, the thermal elements 504 in the metal blank 202 may comprise a single thermal element 504 array controlled by a single lead. In other embodiments, however, the thermal elements 504 positioned in the metal blank 202 may comprise two or more sets of thermal elements 504, where each set is controlled and/or powered independent of the other. In yet other embodiments, each thermal element 504 positioned in the metal blank 202 may be individually controlled and powered independent of the others. Furthermore, the metal blank 202 may be heated without the use of embedded or inserted thermal elements 504, for example, by direct resistive or inductive heating of the metal blank 202, or may otherwise be heated using a microwave emitter or via a tuned microwave receptive material.

In FIG. 6B, the thermal elements 504 are depicted as being positioned within the displacement core 316, but could alternatively (or in addition thereto) be positioned at least partially within the consolidated sand legs 314*b*, without departing from the scope of the disclosure. Positioning the thermal elements in the displacement core 316 (and/or the consolidated sand legs 314*b*) may prove advantageous in allowing an operator (or automated control system) to selectively control the thermal properties of the contents 502 from the interior of the infiltration chamber 312. As with prior embodiments, the thermal elements 504 positioned in the displacement core 316 (and/or the consolidated sand legs 314*b*) may comprise a single thermal element 504 array controlled by a single lead. In other embodiments, the thermal elements 504 positioned in the displacement core 316 (and/or the consolidated sand legs 314*b*) may comprise two or more sets of thermal elements 504, where each set is controlled and/or powered independent of the other. In yet other embodiments, each thermal element 504 positioned in the displacement core 316 (and/or the consolidated sand legs 314*b*) may be individually controlled and powered independent of the others.

Figure 7:
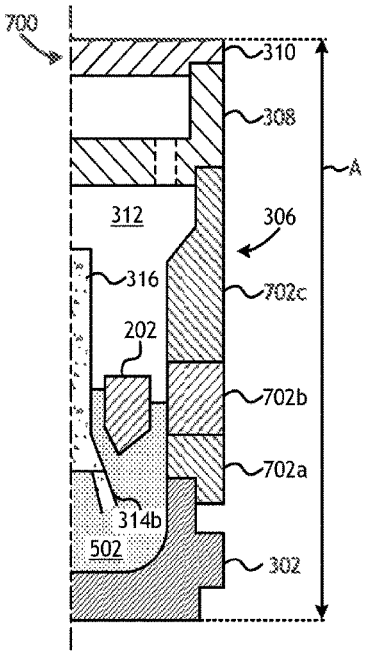
FIG. 7 is a partial cross-sectional view of another exemplary mold assembly.

Referring now to FIG. 7, with continued reference to the prior figures, illustrated is a partial cross-sectional view of another exemplary mold assembly 700, according to one or more embodiments of the disclosure. Similar to prior embodiments, the mold assembly 700 may include one or more of the mold 302, the funnel 306, the binder bowl 308, and the cap 310, but could alternatively also include the gauge ring 304 (FIG. 3). The mold assembly 700 may further include the metal blank 202, the displacement core 316, and one or more consolidated sand legs 314*b* (one shown).

The mold 302, the funnel 306, the binder bowl 308, the cap 310, and the gauge ring 304 (FIG. 3, if used) of the mold assembly 700, or any of the mold assemblies described herein, may be made of the same or dissimilar materials. Suitable materials for the mold 302, the funnel 306, the binder bowl 308, and the cap 310 (and optionally the gauge ring 304 of FIG. 3, if used) include, but are not limited to graphite, alumina ($Al_2O_3$), a metal, a ceramic, and any combination thereof.

In some embodiments, as illustrated, the funnel 306 may be segmented and otherwise separated axially into a plurality of rings 702, shown as a first ring 702*a*, a second ring

702*b*, and a third ring 702*c*. While three rings 702*a-c* are depicted in FIG. 7, it will be appreciated that more or less than three rings 702*a-c* may be used, without departing from the scope of the disclosure. In some embodiments, the rings 702*a-c* may be threaded to each other at corresponding axial ends. In other embodiments, however, the rings 702*a-c* may be joined via other suitable attachment or joining methods.

In some embodiments, the materials of the rings 702*a-c* may be the same. In other embodiments, however, axially adjacent rings 702*a-c* may comprise different materials that exhibit different thermal properties. Additionally, the material of one or more of the rings 702*a-c* may be electrically conductive. In such embodiments, electrical leads (not shown) may be coupled directly to the rings 702*a-c* that are electrically conductive and resistive and current passed through the leads could be used to directly heat the electrically conductive rings 702*a-c*. As a result, the rings 702*a-c* may be characterized and otherwise serve as the thermal elements 504 generally described herein. As will be appreciated, properly locating electrical connections and material designs may allow an operator (or automated control system) to selectively heat desired regions of the infiltration chamber 312 at different or desired rates. Varying the electrical conductivity of each ring 702*a-c* may encompass another method of selectively heating desired regions of the infiltration chamber 312. Conductivity gradients within a given ring 702*a-c* may allow selective heating in an axial and/or circumferential direction.

Figure 8:
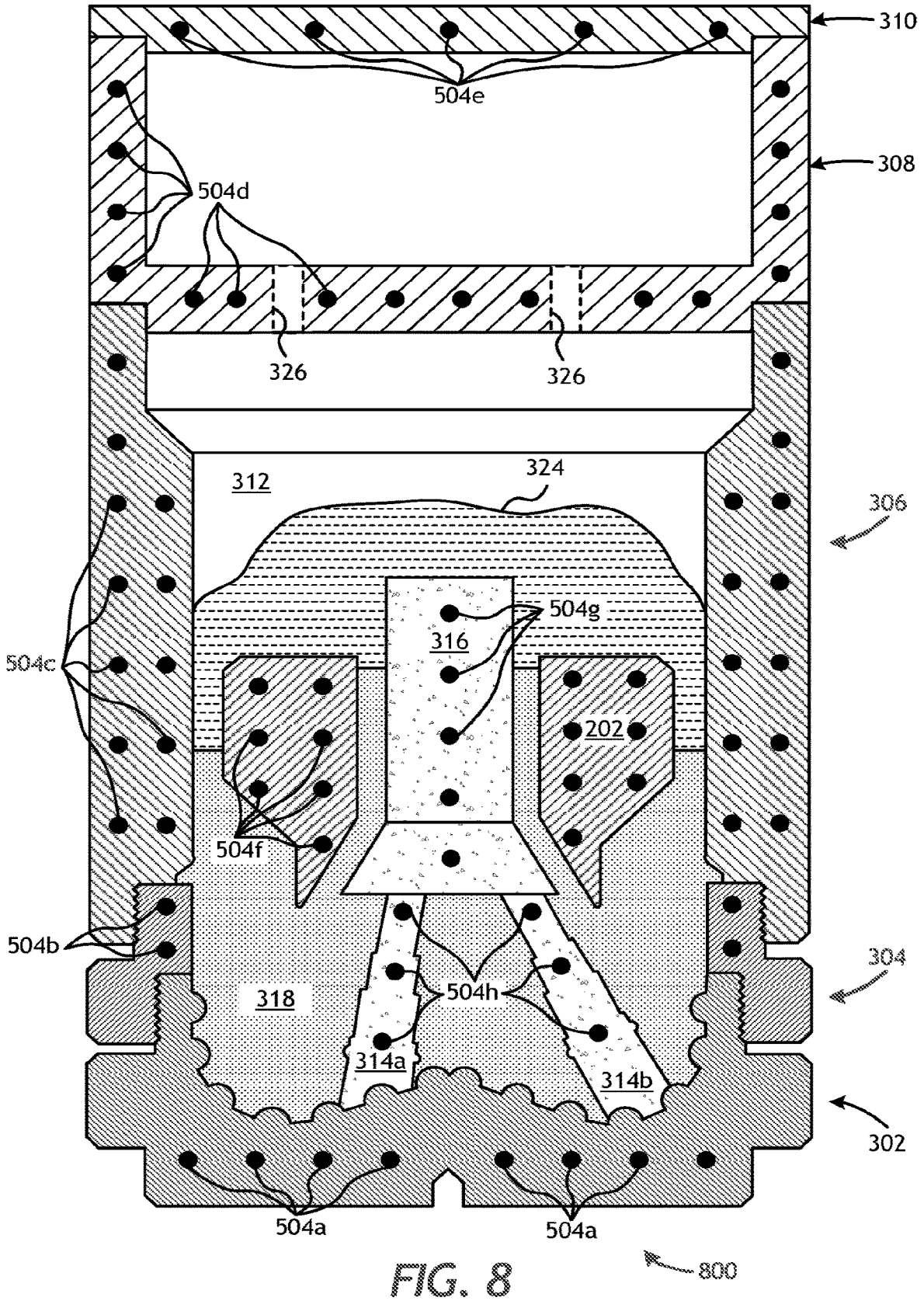
FIG. 8 is a cross-sectional side view of another exemplary mold assembly.

Moreover, in some embodiments, the material composition of the funnel 306 (or the rings 702*a-c*) may be altered or otherwise designed to exhibit a higher thermal resistance value than one or both of the mold 302 and the binder bowl 308. As a result, higher thermal output can be achieved in the region of the funnel 306, where heat loss has historically been an issue. In embodiments that employ the rings 702*a-c*, this may prove advantageous in independently designing the rings 702*a-c* to exhibit specific thermal resistance values and thereby target the highest heating into the desired regions of the mold assembly 700, such as radially adjacent the metal blank 202. Accordingly, in such embodiments, uniform heat may be generated in the whole funnel 306 or rings 706*a-c*, and the thermal conductivity may then be tailored to specific locations to transfer greater quantities of heat energy into or away from specific areas of the mold assembly 700. As will be appreciated, this could apply both axially and circumferentially Referring now to FIG. 8, illustrated is a cross-sectional side view of another exemplary mold assembly 800, according to one or more embodiments. The mold assembly 800 may be similar in some respects to the mold assembly 300 of FIG. 3 and therefore may be best understood with reference thereto, where like numerals will represent like components not described again in detail. Moreover, the mold assembly 800 may be similar in some respects to the mold assemblies 500*a-c* and 600*a,b* of FIGS. 5A-5C and 6A-6B, respectively, in that the contents within the infiltration chamber 312 may be selectively and/or actively heated using the thermal elements 504 positioned within any of the component parts of the mold assemblies 600*a,b*.

In the illustrated embodiment, an array of first thermal elements 504*a* may be positioned within the mold 302, an array of second thermal elements 504*b* may be positioned within the gauge ring 304, an array of third thermal elements 504*c* may be positioned within the funnel 306, an array of fourth thermal elements 504*d* may be positioned within the binder bowl 308, an array of fifth thermal elements 504*e* may be positioned within the cap 310, an array of sixth thermal elements 504*f* may be positioned within the metal blank 202, an array of seventh thermal elements 504*g* may be positioned within the displacement core 316, and an array of eight thermal elements 504*h* may be positioned within the consolidated sand legs 314*a,b*. It will be appreciated that one or more of the arrays of thermal elements 504*a-h* may be omitted from any given component part of the mold assembly 800, without departing from the disclosure. In some embodiments, all of the arrays of thermal elements 504*a-h* may be included in the mold assembly 800 and controlled and otherwise powered via a single lead, such that the thermal energy output of each array of thermal elements 504*a-h* may be uniform. In other embodiments, however, some or all of the arrays of thermal elements 504*a-h* of the mold assembly 800 may be controlled independently or in groups, without departing from the scope of the disclosure. As a result, an operator (or automated control system) may be able to selectively and actively influence the thermal gradient across the mold assembly 800 during heating and cooling operations.

In one or more embodiments, heating of the mold assembly 800 may occur through induction heating that includes one or both eddy current and magnetic hysteresis. In such embodiments, the field frequency generated by the thermal elements 504*a-h* can be varied to control the depth of penetration of the magnetic field, and thereby control the depth of penetration of thermal energy into the infiltration chamber 312. As will be appreciated, such selective heating can lead to surface heating of the metal blank 202 and heating of the liquid-metal binder material 324 around and surrounding the metal blank 202. In some embodiments, the surfaces of the metal blank 202 may melt to allow for a weld joint instead of a braze joint. In some embodiments, the field frequency of the thermal elements 504*a-h* may be varied over time to selectively heat certain portions of the internal contents of the infiltration chamber 312 to certain depths, thereby helping facilitate directional solidification of the molten contents.

In some embodiments, the thermal elements 504*a-h* included in the mold assembly 800 may be operated to facilitate or help facilitate infiltrating the binder material 324 into the matrix reinforcement materials 318, as generally described above. In such embodiments, the mold assembly 800 may not be required to be heated in the furnace 402 (FIG. 4A), or heating in the furnace 402 may otherwise be minimized to save on heating costs. If the furnace 402 is used, the thermal elements 504*a-h* may simultaneously be operated to selectively and actively heat the binder material 324 into the matrix reinforcement materials 318 or to preheat the matrix reinforcement materials 318 before infiltration by the binder material 324. Accordingly, in such embodiments, the thermal elements 504*a-h* may function as a separate induction heating unit and otherwise serve as a replacement or support for the furnace 402. In yet other embodiments, electrical current may be passed through the outer thermal elements 504*a-e* to induce a current in the inner thermal elements 504*f-h*. This may prove advantageous in allowing internal heating without the need for hard electrical connections to inner thermal elements.

Following infiltration, and while cooling the molten contents within the mold assembly 800, some or all of the thermal elements 504*a-h* may be selectively and actively operated to intelligently and/or gradually reduce the temperature of the molten contents and thereby tailor the directional solidification of the infiltrated downhole tool within the mold assembly 800. In such embodiments, one or more thermocouples (not shown) may be strategically positioned within selected portions of the mold assembly 800 or portions of the infiltrated downhole tool to receive real-time temperature updates and status of the cooling process. As a result, an operator or a programmed computer routine may be able to optimize the intensity of any of the thermal elements 504*a-h* in real-time to optimize the thermal energy input to the infiltrated downhole tool in real-time. In such embodiments, the insulation enclosure 406 (FIGS. 4B and 4C) may be generally unnecessary, but may nonetheless be utilized for safety reasons.

It will be appreciated that the various embodiments described and illustrated herein may be combined in any combination, in keeping within the scope of this disclosure. Indeed, variations in the placement, number, and operation of the thermal elements 504 described herein may be implemented in any of the embodiments and in any combination, without departing from the scope of the disclosure.

Statement 1. A mold assembly for fabricating an infiltrated drill bit may comprise a mold forming a bottom of the mold assembly; a funnel operatively coupled to the mold; an infiltration chamber defined at least partially by the mold and the funnel to receive and contain matrix reinforcement materials and a binder material used to form the infiltrated drill bit; a displacement core arranged within the infiltration chamber and having one or more legs that extend therefrom; a metal blank arranged about the displacement core within the infiltration chamber; and one or more thermal elements, wherein the one or more thermal elements are in thermal communication with the infiltration chamber.

Statement 2. The mold assembly of statement 1, further comprising at least one of: a gauge ring interposing the mold and the funnel, wherein the funnel is operatively coupled to the mold via the gauge ring; a binder bowl positioned above the funnel; and a cap positionable on the binder bowl or funnel, wherein the one or more thermal elements are further positioned within one or more of the gauge ring, the binder bowl, and the cap.

Statement 3. The mold assembly of statement 2, wherein the one or more thermal elements are embedded within at least one of the mold, the gauge ring, the funnel, the binder bowl, the cap, the displacement core, the one or more legs, and the metal blank.

Statement 4. The mold assembly of statement 2, wherein the one or more thermal elements are arranged within a cavity defined in at least one of the mold, the gauge ring, the funnel, the binder bowl, the cap, the displacement core or associated legs, and the metal blank.

Statement 5. The mold assembly of statements 1 or 2, wherein the one or more thermal elements are selected from the group consisting of a heating element, a heat exchanger, a radiant heater, an electric heater, an infrared heater, an induction heater, one or more induction coils, a heating band, one or more heated coils, a heated cartridge, resistive heating elements, a refractory and conductive metal coil, strip, or bar, a heated fluid (flowing or static), an exothermic chemical reaction, a microwave emitter, a tuned microwave receptive material, an exothermal subatomic reaction, or any combination thereof.

Statement 6. The mold assembly of statements 1, 2, or 5, wherein the one or more thermal elements comprise a single thermal element that forms a spiral array.

Statement 7. The mold assembly of statements 1, 2, 5, or 6, wherein the one or more thermal elements comprises at least a first set of thermal elements and a second set of thermal elements, and wherein the first and second sets of thermal elements are controlled independent of each other.

Statement 8. The mold assembly of statements 1, 2, or 5-8, wherein the one or more thermal elements comprises a plurality of individual thermal elements that are each powered independent of each other.

Statement 9. The mold assembly of statements 1, 2, or 5-9, wherein the one or more thermal elements are looped and arranged in a double array within a cavity formed within the funnel, wherein a first portion of the one or more thermal elements are radially offset from a second portion of the one or more thermal elements with respect to a central axis within the cavity, and positioned within at least one of the mold, the funnel, the displacement core, the one or more legs, and the metal blank.

Statement 10. A method for fabricating an infiltrated downhole tool, comprising: providing a mold assembly having component parts that include a mold that forms a bottom of the mold assembly and a funnel operatively coupled to the mold, wherein the mold and the funnel at least partially define an infiltration chamber in the mold assembly; imparting thermal energy to the infiltration chamber with one or more thermal element: and heating contents contained within the infiltration chamber with the one or more thermal elements.

Statement 11. The method of statement 10, wherein the contents include matrix reinforcement materials and a binder material, and wherein heating the contents contained within the infiltration chamber comprises heating the matrix reinforcement materials and the binder material and thereby infiltrating the binder material into the matrix reinforcement materials.

Statement 12. The method of statements 10 or 11, wherein the component parts further include one or more of a gauge ring interposing the mold and the funnel, a binder bowl positioned above the funnel, a cap positionable on the binder bowl or funnel, a displacement core arranged within the infiltration chamber and having one or more legs that extend therefrom, and a metal blank arranged about the displacement core within the infiltration chamber, and wherein imparting thermal energy to the infiltration chamber.

Statement 13. The method of statement 12 further comprises: selectively controlling an output of the thermal energy from the one or more thermal elements; and varying a thermal profile of the contents contained within the infiltration chamber and thereby facilitating directional solidification of the contents.

Statement 14. The method of statement 13, wherein selectively controlling the output of the thermal energy from the one or more thermal elements comprises generating a thermal gradient along an axial height of the mold assembly with the one or more thermal elements.

Statement 15. The method of statement 13, wherein the one or more thermal elements include at least a first array of thermal elements and a second array of thermal elements, the method further comprising operating the first and second arrays of thermal elements independently.

Statement 16. The method of statement 13, further comprising: monitoring a real-time temperature of the contents contained within the infiltration chamber with one or more thermocouples positioned within the infiltration chamber; and selectively controlling the output of thermal energy from the one or more thermal elements based on the real-time temperature of the contents.

Statement 17. The method of statement 12, further comprising: placing the mold assembly within a furnace; removing the mold assembly from the furnace; selectively controlling an output of the thermal energy from the one or more thermal elements; and varying a thermal profile of the contents contained within the infiltration chamber and thereby facilitating directional solidification of the contents.

Statement 18. The method of statements 10-12, wherein the one or more thermal elements are looped and arranged in a double array within a cavity formed within the funnel, wherein a first portion of the one or more thermal elements are radially offset from a second portion of the one or more thermal elements with respect to a central axis within the cavity.

Statement 19. A method, comprising: introducing a drill bit into a wellbore, the drill bit being formed within a mold assembly having component parts that include a mold that forms a bottom of the mold assembly, a funnel operatively coupled to the mold, a displacement core arranged within an infiltration chamber defined at least partially by the mold and the funnel, one or more legs that extend from the displacement core, and a metal blank arranged about the displacement core within the infiltration chamber; heating contents contained within the infiltration chamber with the one or more thermal elements; and drilling a portion of the wellbore with the drill bit.

Statement 20. The method of claim 19, wherein forming the drill bit may comprise imparting thermal energy to the infiltration chamber with one or more thermal elements looped and arranged in a double array within a cavity formed within the funnel, wherein a first portion of the one or more thermal elements are radially offset from a second portion of the one or more thermal elements with respect to a central axis within the cavity positioned within at least one of the component parts of the mold assembly.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for fabricating an infiltrated downhole tool, comprising:

providing a mold assembly having component parts comprising a mold that forms a bottom of the mold assembly and a funnel operatively coupled to the mold, wherein the mold and the funnel at least partially define an infiltration chamber in the mold assembly;

imparting thermal energy to the infiltration chamber with one or more thermal element;

heating contents contained within the infiltration chamber with the one or more thermal elements;

monitoring a real-time temperature of the contents contained within the infiltration chamber with one or more thermocouples positioned within the infiltration chamber; and selectively controlling the output of thermal energy from the one or more thermal elements based on the real-time temperature of the contents.

2. The method of claim 1, wherein the contents comprise matrix reinforcement materials and a binder material, and wherein heating the contents contained within the infiltration chamber comprises heating the matrix reinforcement materials and the binder material and thereby infiltrating the binder material into the matrix reinforcement materials.

3. The method of claim 1, wherein the component parts further comprise one or more of a gauge ring interposing the mold and the funnel, a binder bowl positioned above the funnel, a cap positionable on the binder bowl or funnel, a displacement core arranged within the infiltration chamber and having one or more legs that extend therefrom, and a metal blank arranged about the displacement core within the infiltration chamber, and wherein imparting thermal energy to the infiltration chamber.

4. The method of claim 3, further comprising:

placing the mold assembly within a furnace;

removing the mold assembly from the furnace;

varying a thermal profile of the contents contained within the infiltration chamber and thereby facilitating directional solidification of the contents.

5. The method of claim 1 further comprising:

varying a thermal profile of the contents contained within the infiltration chamber and thereby facilitating directional solidification of the contents.

6. The method of claim 5, wherein selectively controlling the output of the thermal energy from the one or more thermal elements comprises generating a thermal gradient along an axial height of the mold assembly with the one or more thermal elements.

7. The method of claim 5, wherein the one or more thermal elements include at least a first array of thermal elements and a second array of thermal elements, the method further comprising controlling the first and second arrays of thermal elements independently.

8. The method of claim 5, wherein the one or more thermal elements include a collection of thermal elements that are controlled together.

9. The method of claim 1, wherein the one or more thermal elements are looped and arranged in a double array within a cavity formed within the funnel, wherein a first portion of the one or more thermal elements are radially offset from a second portion of the one or more thermal elements with respect to a central axis within the cavity.

10. A method for fabricating an infiltrated downhole tool, comprising:

providing a mold assembly having component parts comprising a mold that forms a bottom of the mold assembly and a funnel operatively coupled to the mold, wherein the mold and the funnel at least partially define an infiltration chamber in the mold assembly;

positioning one or more thermal elements within at least one of the mold, the funnel, or a metal blank;

selectively controlling an output of thermal energy from the one or more thermal elements;

imparting the thermal energy to the infiltration chamber;

heating contents contained within the infiltration chamber with the one or more thermal elements; and monitoring a real-time temperature of the contents contained within the infiltration chamber with one or more thermocouples positioned within the infiltration chamber.

11. The method of claim 10, wherein the component parts further comprise one or more of a gauge ring interposing the mold and the funnel, one or more blanks at least partially connected to the infiltration chamber, a binder bowl positioned above the funnel, and a cap positionable on the binder bowl or funnel, and a displacement core arranged within the infiltration chamber and having one or more legs that extend therefrom.

12. The method of claim 10, wherein the contents contained within the infiltration chamber comprise matrix reinforcement materials and binder material, and wherein heating the contents contained within the infiltration chamber comprises heating matrix reinforcement materials and the binder material and thereby infiltrating the binder material into the matrix reinforcement materials.

13. The method of claim 10, wherein the one or more thermal elements are looped and arranged in a double array within a cavity formed within the funnel, the one or more blanks, the binder bowl, and the cap.

14. The method of claim 13, wherein a first portion of the one or more thermal elements are radially offset from a second portion of the one or more thermal elements with respect to a central axis within the cavity.

15. The method of claim 10, wherein selectively controlling the output of the thermal energy from the one or more thermal elements comprises generating a thermal gradient along an axial height of the mold assembly with the one or more thermal elements.

16. The method of claim 10, wherein the one or more thermal elements include at least a first array of thermal elements and a second array of thermal elements, the method further comprising operating the first and second arrays of thermal elements independently.

17. The method of claim 10 further comprising varying a thermal profile of the contents contained within the infiltration chamber and thereby facilitating directional solidification of the contents.

18. The method of claim 10, further comprising selectively controlling the output of thermal energy from the one or more thermal elements based on the real-time temperature of the contents.

19. The method of claim 10, further comprising:

placing the mold assembly within a furnace; and removing the mold assembly from the furnace.

20. The method of claim 10, wherein selectively controlling an output of thermal energy from the one or more thermal elements comprises controlling a collection of the thermal elements together.

* * * * *